United States Patent [19]

Bertoli

[11] Patent Number: 5,070,554

[45] Date of Patent: Dec. 10, 1991

[54] COVER ASSEMBLY FOR A SANITARY FIXTURE

[75] Inventor: Franco Bertoli, Milan, Italy

[73] Assignee: American Standard Inc., New York, N.Y.

[21] Appl. No.: 564,680

[22] Filed: Aug. 8, 1990

Related U.S. Application Data

[63] Continuation of Ser. No. 357,755, May 26, 1989, abandoned.

[30] Foreign Application Priority Data

Jun. 15, 1988 [IT] Italy ..... 34854 B/88

[51] Int. Cl.[5] ..... A47K 1/04

[52] U.S. Cl. ..... 4/630; 4/631; 4/654

[58] Field of Search ..... 4/234, 236, 630, 553, 4/661, 443, 347, 619, 637, 654, 658, 631; 312/26, 21, 284, 223

[56] References Cited

U.S. PATENT DOCUMENTS

| | | | |
|---|---|---|---|
| 494,191 | 3/1893 | La Porte | 312/228 X |
| 604,983 | 5/1898 | Hall | 4/234 |
| 966,298 | 8/1910 | Beland | 4/654 |
| 1,318,229 | 10/1919 | Peters | 312/228 |
| 1,409,330 | 3/1922 | Aper | 4/630 X |
| 1,810,599 | 6/1931 | French | 312/228 |
| 1,982,117 | 11/1934 | Murie | 4/637 X |
| 2,173,185 | 9/1939 | Stanton | 4/663 |
| 2,355,615 | 8/1944 | Helmuth | 4/553 |
| 2,426,152 | 8/1947 | Meldahl | 4/630 X |
| 2,725,272 | 11/1955 | McCarton | 312/228 |
| 2,850,742 | 9/1958 | Glintz | 312/228 X |
| 2,907,048 | 10/1959 | Gould | 4/663 |
| 3,346,886 | 10/1967 | Kashiwamura | 4/637 |
| 3,378,855 | 4/1968 | Springer | 4/347 X |
| 3,940,196 | 2/1976 | Retchel | 312/228 X |
| 3,993,376 | 11/1976 | Meldahl | 4/630 X |
| 4,384,375 | 5/1983 | Gerome | 4/236 X |
| 4,616,368 | 10/1986 | Nagai et al. | 4/443 X |
| 4,622,704 | 11/1986 | Chung | 4/443 |
| 4,838,175 | 6/1989 | Hauville | 312/223 X |

FOREIGN PATENT DOCUMENTS

| | | | |
|---|---|---|---|
| 2514800 | 4/1983 | France | 4/630 |

*Primary Examiner*—Henry J. Recla
*Assistant Examiner*—Robert M. Fetsuga
*Attorney, Agent, or Firm*—Blum Kaplan

[57] ABSTRACT

A sanitary fixture and cover assembly is disclosed. The cover, which is hinged to the sanitary fixture, encloses at least the area where the water delivery means, i.e. faucet, is mounted.

2 Claims, 2 Drawing Sheets

COVER ASSEMBLY FOR A SANITARY FIXTURE

This is a continuation of application Ser. No. 07/357,755, filed on May 26, 1989, now abandoned.

BACKGROUND OF THE DISCLOSURE

1. Field of the Invention

This invention is directed to a sanitary cover assembly for a sanitary fixture, such as a bidet, a sink, a bathtub and the like.

2. Summary of the Invention

An object of the invention is to provide an efficient and convenient cover assembly in combination with a sanitary fixture, such as the sanitary fixtures used in a bathroom.

Another object of the invention is to provide additional support surfaces, within the concavity of the bowl, to mount and to conceal faucets and, after use, close the cover to protect the faucet and sanitary fixture from dust and dirt, thereby making bathroom cleaning operations easier. This object is achieved by the invention, as characterized in the following description thereof.

When the sanitary fixture is not being used, a cover protects the area where the faucet is located and substantially the entire bowl, and thus protects it from dust. Also, the cover provides the user of the bathroom with a convenient support surface which can be utilized when other bathroom fixtures are being used.

BRIEF DESCRIPTION OF THE DRAWINGS

The invention is described in detail below with the aid of the attached FIGURES, which show two exemplary embodiments thereof.

DETAILED DESCRIPTION OF THE PREFERRED EMBODIMENT

Figure 1:
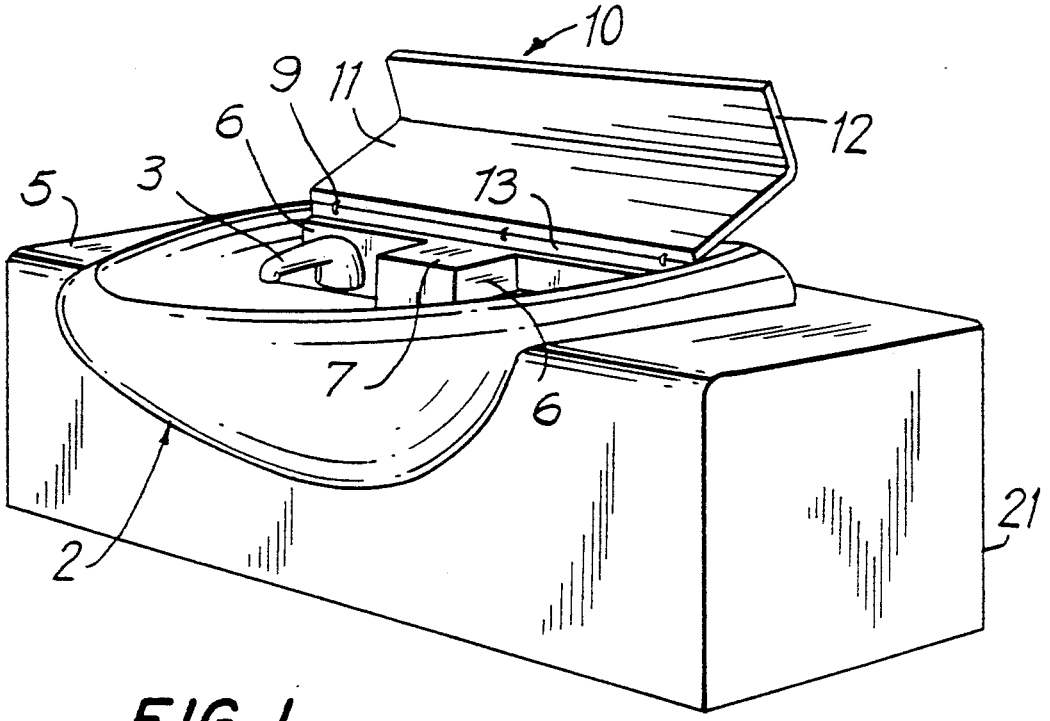
FIG. 1 is a perspective view of a sink embodying one form of the invention.
Figure 2:
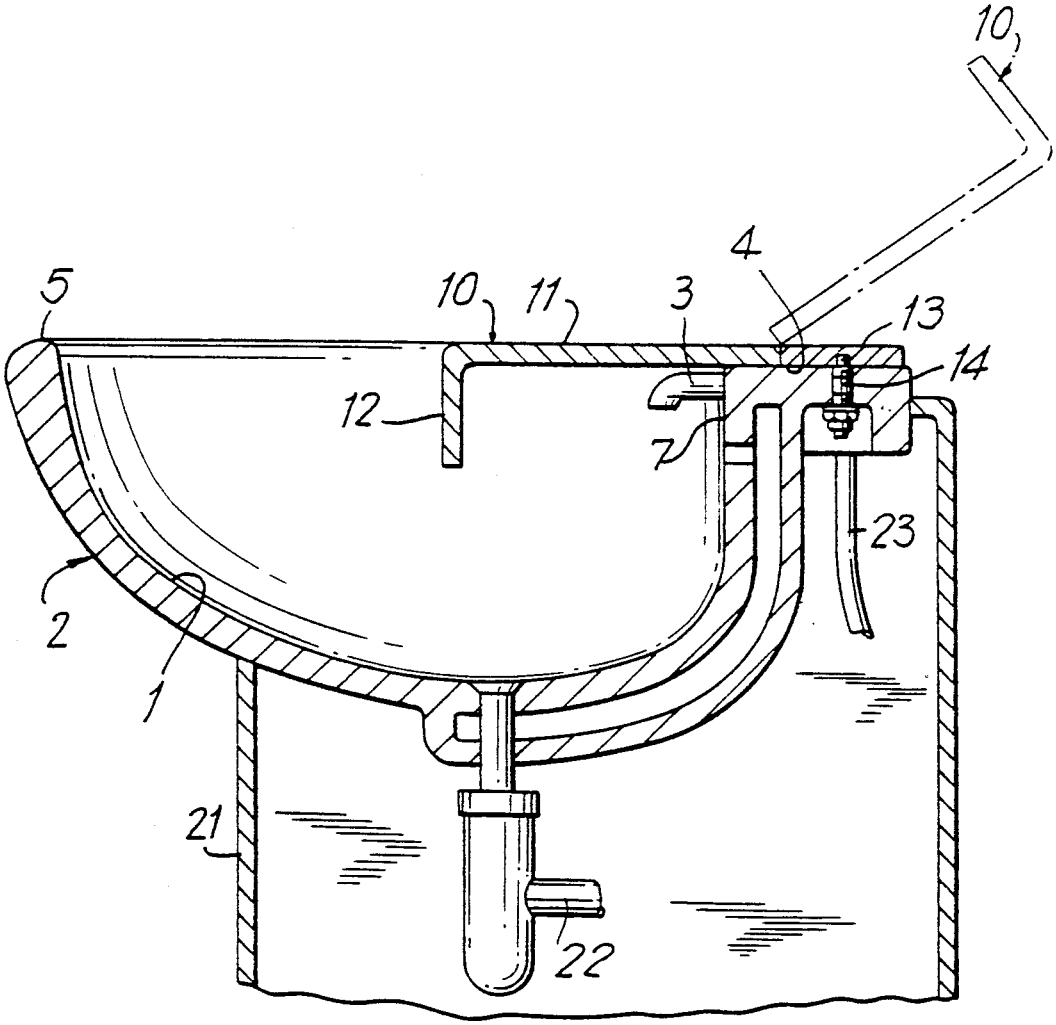
FIG. 2 is a sectional view along the vertical plane of symmetry of the sink in FIG. 1.

Referring in detail to the drawings and, particularly, FIGS. 1 and 2, is shown a cover 10 which covers at least a portion of the area of the concavity of the bowl 1 of sink 2 where the delivery means, such as a faucet 3, is mounted. Bowl 1 is of a known type and can vary in shape, depending on its function, such as a sink, bidet or bathtub.

In FIGS. 1 and 2, cover 10 comprises a flat portion 11 and is pivoted by hinge 9 to an additional portion 18, fastened by means of screws 14 or other equivalent means to the upper rear edge 4 of bowl 1.

Portion 11 of cover 10 is substantially coplanar with both portion 13 and the upper front edge 5 of bowl 1. Faucet 3 is mounted within the concavity of bowl 1, beneath cover 10, shown in FIG. 2. Shown in FIG. 1, there is provided within the concavity of bowl 1, hollowed out concave housings 6 in the form of a step or ledge positioned below rear edge 4, capable of accommodating a faucet 3 or other water delivery means, and/or capable of constituting soap shelves.

As illustrated in FIG. 1, two housings 6 are separated from one another by a central element 7, located as an extension of the edge 4, on which portion 11 of cover 10 rests when in its closed position, FIG. 2. Portion 11 of cover 10 is partially supported by the edge of portion 12 when resting against the inner wall surface forming the concavity of bowl 1.

End portion 12 is perpendicularly joined to portion 11, and extends downward into the concavity of bowl 1. Portion 12 provides an additional cover for faucet 8 to prevent dust from accumulating thereon when not in use.

Illustrated in FIGS. 1 and 2, is a piece of furniture such as a cabinet 21, which supports sink 2. Sink 2 is connected to drain 22 and water supply pipes 23.

Figure 3:
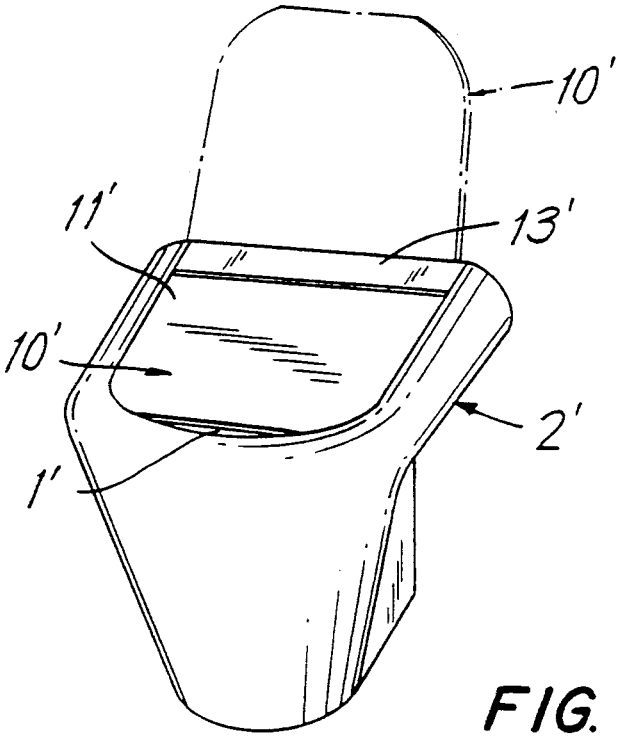
FIG. 3 is a perspective view of a bidet, illustrating another form of the invention.

In the embodiment illustrated in FIG. 3, portion 11' of cover 10' is mounted on bidet 2' and is generally coplanar with the upper rim formed by the front and side walls of bidet 2' and of the concavity of bowl 1'. Note the portion 12 of cover 10' is not provided.

It is claimed:

1. In combination, a cover assembly mounted to a sanitary fixture, said sanitary fixture including a bowl defining a concavity and having an upper rim surface and a top rear section and water delivery means mounted to said bowl, and a flat deck portion extending from the top rear section of said bowl;

a cover assembly having a first generally flat segment shaped to cover said flat deck portion, and means mounting said first segment thereto;

a second generally flat segment shaped to cover at least a portion of the area forming a portion of the concavity of said bowl and said water delivery means, and at least one hinge hingedly mounted between said first and second segments of said cover so that said water delivery means and said at least a portion of said bowl are protected form dust when said cover is in its closed position;

said flat deck portion being recessed with respect to the upper rim surface of said bowl so that when said cover assembly is in its closed position, its top surface thereof is generally coplanar with the upper rim surface of said bowl;

said water delivery means being mounted within said bowl and positioned below said cover when in its closed position;

said second segment having an additional segment extending essentially perpendicular therefrom and which extends into the concavity of the bowl and rests directly against the inner wall surface forming the concavity of said bowl when said cover is in its closed position.

2. The combination of claim 1, wherein said sanitary fixture is a sink.

* * * * *